United States Patent [19]

Kincaid et al.

[11] Patent Number: 4,630,457

[45] Date of Patent: Dec. 23, 1986

[54] LOCK WITH REMOVABLE PLUG

[75] Inventors: Herbert Kincaid, Libertyville; Alan D. Favia, Lake in the Hills, both of Ill.

[73] Assignee: Eastern Company, Naugatuck, Conn.

[21] Appl. No.: 685,473

[22] Filed: Dec. 24, 1984

[51] Int. Cl.[4] ..... E05B 29/04
[52] U.S. Cl. ..... 70/369; 70/337
[58] Field of Search ..... 70/369, 367, 368, 371, 70/337, 338, 340

[56] References Cited

U.S. PATENT DOCUMENTS

| | | | |
|---|---|---|---|
| 2,061,456 | 11/1936 | Falk | 70/369 |
| 3,799,555 | 9/1968 | Gray | 70/369 |
| 4,191,037 | 3/1980 | Patriquin | 70/369 |
| 4,272,975 | 6/1981 | Patriquin | 70/369 |
| 4,398,405 | 8/1983 | Patriquin . | |
| 4,405,843 | 9/1983 | Wolniak et al. . | |
| 4,427,852 | 1/1984 | Wolniak et al. . | |

OTHER PUBLICATIONS

Chicago Single Bitted Locks, (a Chicago Lock Company brochure) p. 40.

*Primary Examiner*—Robert L. Wolfe
*Attorney, Agent, or Firm*—Wood, Dalton, Phillips, Mason & Rowe

[57] ABSTRACT

A lock is disclosed having a lock barrel with an opening and a key plug rotatable within the opening. The plug is rotatable between first and second operative positions and a third position in which the plug can be withdrawn from the barrel. A tab on the plug abuts a barrel shoulder to hold the plug in the barrel except when the plug is in the third position, where the tab is aligned with an axial slot to permit axial withdrawal of the plug from the barrel. At least one tumbler is adapted to lock the plug against turning, and another tumbler is adapted to prevent the plug from turning to the third position and to allow rotation between the first and second positions. One key operates the one tumbler to permit rotation between operative positions and a second key operates the other tumbler to permit axial withdrawal of the plug from the barrel.

11 Claims, 6 Drawing Figures

FIG. 1
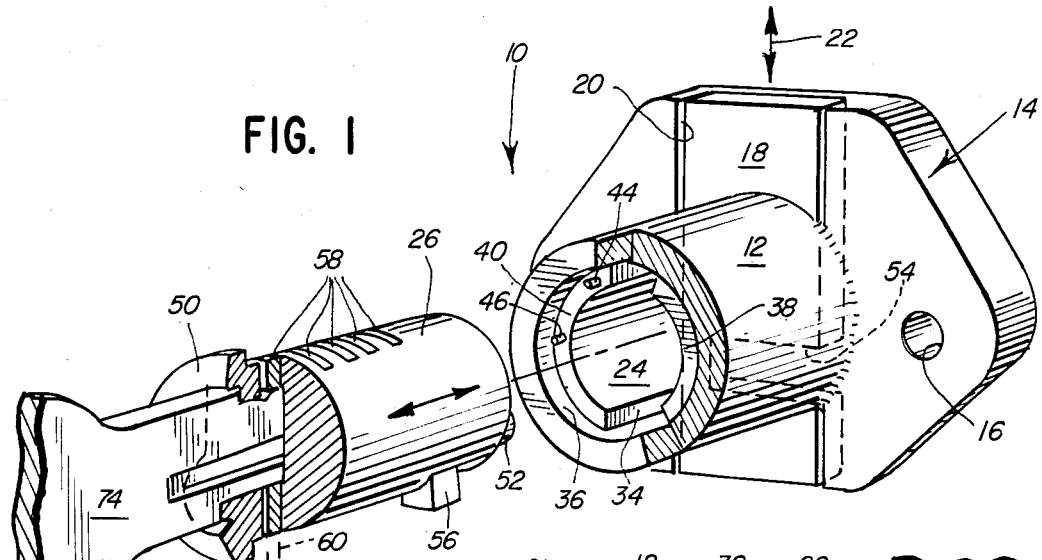
FIG. 2
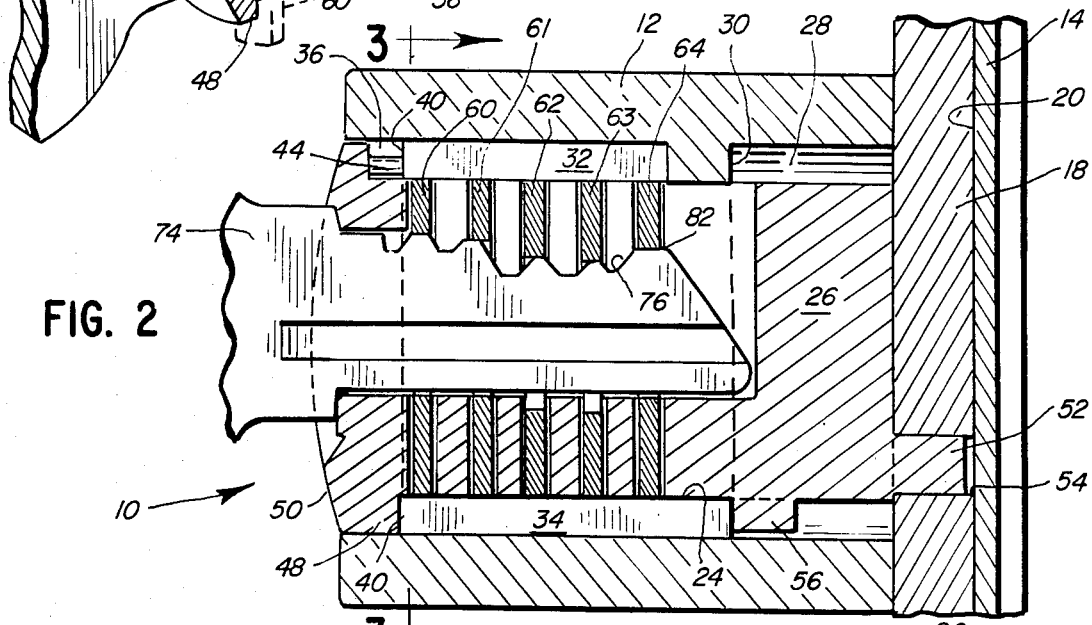
FIG. 3
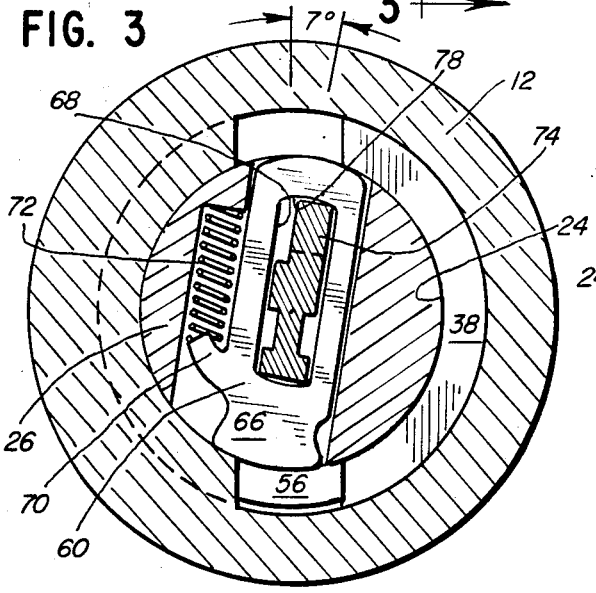
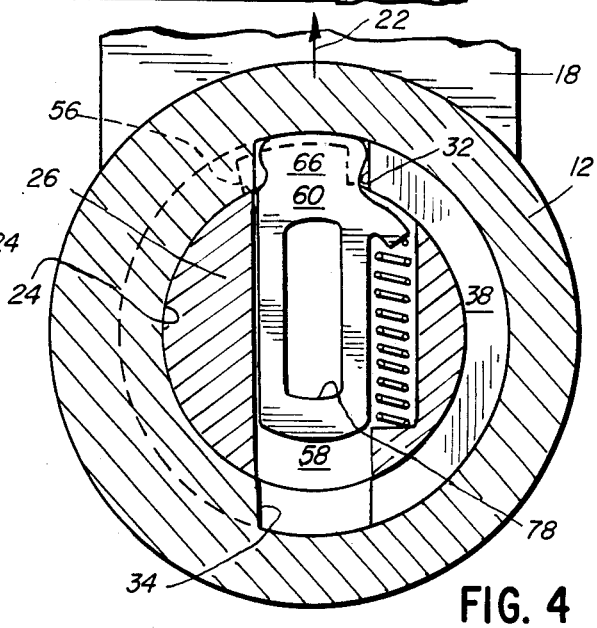
FIG. 4

LOCK WITH REMOVABLE PLUG

BACKGROUND OF THE INVENTION

1. Technical Field

The present invention relates to a key lock and more particularly to a key lock with a removable plug.

2. Background Art

Key locks are used to provide security for many different things, such as desk drawers and electrical switches. Often, unauthorized copies of the keys and/or employee turnover make it desirable to change such locks so that they are operable by different keys.

In order to change the lock in this manner, it is necessary to remove the plug from the lock barrel so that the tumblers in the plug can be changed. Some locks must be completely disassembled from the object (e.g. drawer) being locked in order to do this.

Some other structures have also been provided to permit removal of the plug without disassembly of the entire lock. For example, one known lock has a spring actuated crescent on the plug which engages a groove in the barrel to hold the plug therein. When the plug is rotated to a particular angular position, a wire may be inserted through a hole in the plug to retract the crescent to permit withdrawal of the plug. Insertion of the wire is somewhat difficult and thus makes withdrawal of the plug difficult as well.

Still another structure is shown in U.S. Pat. No. 4,398,405 in which one tumbler is provided at the end of the plug with a retaining end received in a groove in the barrel to prevent removal of the plug. A key (which is longer than the operating key) may be inserted into the plug to move the end tumbler so that its other end projects from the plug and into a longitudinal groove to permit removal of the plug. With this lock, the tumbler which is used to retained the plug in the barrel may be subjected to longitudinal shear forces should someone attempt to remove the plug with an operating key. Since tumblers have a thin longitudinal dimension and are thus not readily adapted to withstand such shear forces, the tumbler retaining the plug in the barrel can be sheared off by a person trying to do so. Further, removal of the plug with this lock requires that a special key be made from a different (i.e. longer) blank than the operating key for the lock. Still further, a person with an operating key and an understanding of this lock could with only a small amount of trial and error have a key made for removal of the plug.

The present invention is directed toward overcoming one or more of the problems above.

SUMMARY OF THE INVENTION

In one aspect of the present invention, the lock has a barrel with an opening and a key plug rotatable within the opening. The plug is rotatable between first and second operative positions and a third position in which the plug can be withdrawn from the barrel. At least two tumblers are provided, one adapted to lock the plug against turning, and the second adapted to prevent the plug from turning to the third position but allowing rotation between the first and second positions. A tab on the plug abuts a barrel shoulder to hold the plug in the barrel except when the plug is in the third position, where the tab is aligned with an axial slot in the barrel shoulder to permit axial withdrawal of the plug from the barrel.

With the present invention, the key plug may be quickly and easily removed from and/or installed in the barrel of the lock. The key which is used to accomplish this operation may be made from the same type of blank as the operating key. Further, the tab provided on the plug may be rigidly formed to prevent shearing in the event someone attempts to remove the plug without the proper key. Still further, inasmuch as one or more tumblers may be used to hold the plug against rotation to the removal position, and since those tumblers may be placed at any axial position in the plug, the lock may be manufactured so as to effectively prevent an unauthorized person from creating a plug changing key from an operating key.

BRIEF DESCRIPTION OF THE DRAWINGS

FIG. 1 is a perspective and partial cross-sectional view of the present invention with the plug removed;

FIG. 2 is a partial cross-sectional view showing the plug within the barrel and in the removal position;

FIG. 3 is a cross-sectional view taken along line 3—3 of FIG. 2;

FIG. 4 is a cross-sectional view similar to FIG. 3 but showing the lock in the bolt locking position;

DESCRIPTION OF THE PREFERRED EMBODIMENT

Figure 5:
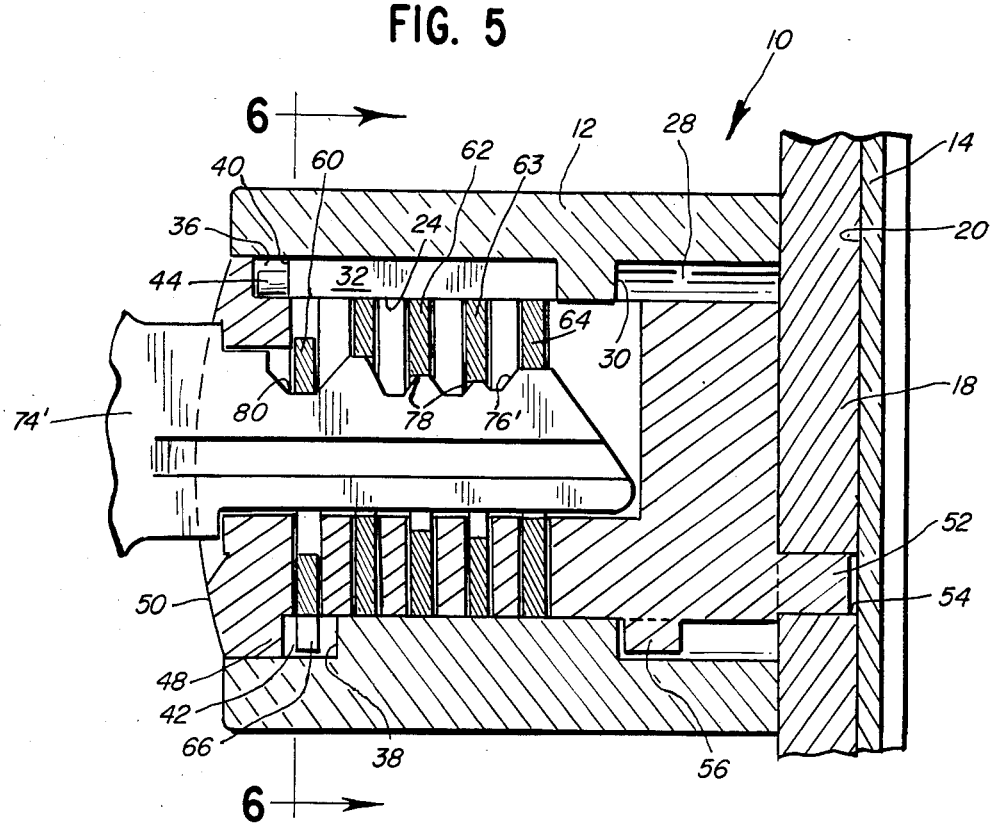
FIG. 5 is a cross-sectional view taken along line 5—5 of FIG. 6 and showing the lock in the bolt open position with an operating key therein.

The key lock 10 of the present invention is shown disassembled in FIG. 1. A barrel 12 is rigidly fixed to the base 14 of the key lock 10. The base 14 may be suitably secured to the object to be locked, for example, by bolting the base 14 to the inside of a drawer (not shown) with the barrel 12 extending through and facing outside the drawer. Holes 16 are provided in the base 14 for that purpose.

A dead bolt 18 is received within a slot 20 in the base 14 and may be reciprocated up and down as indicated by the arrow 22 to lock and unlock the drawer. Operation of the lock 10 to reciprocate the dead bolt 18 is described below.

It should be understood that the particular base 14 shown and the component (i.e. dead bolt 18) operated by the lock 10 are for purposes of illustration only. The present invention could be used with any number of bases. Further, the lock of the present invention could be used to operate any number of components as well, such as switch terminals.

The barrel 12 defines a tubular opening 24 within which is received a key plug 26. The rear end 28 of the tubular opening 24 is enlarged so that an annular, rearwardly facing shoulder 30 is defined. Axially extending slots or grooves 32,34 are disposed on opposite sides of the tubular opening 24. One axial slot 32 extends only partially to the enlarged rear end 28 while the other extends fully into the enlarged rear end 28 to define an opening in the rearwardly facing shoulder 30.

The front end 36 of the tubular opening 24 is also enlarged to define a pair of forwardly facing shoulders 38,40 on opposite sides of the axially extending slots 32,34. The forwardly facing shoulders 38,40 do not lie in the same plane (i.e. the shoulder 38 on the right in FIG. 1 is recessed into the barrel 12 more than the shoulder 40 on the left). As a result, what will be referred to herein as an annular slot or groove 42 (see particularly FIG. 5) is defined between the recessed forwardly facing shoulder 38 (on the right in FIG. 1) and the plane of the other forwardly facing shoulder 40. This is referred to as an annular slot 42 even though there is no forward side to it (other than the imaginary plane of the left forwardly facing shoulder 40) because, as will be apparent, this slot 42 need not be at the forward end of the tubular opening 24 but could as well be located at an intermediate location therein. Locating the annular slot 42 at the front end as shown is however the preferred embodiment for ease of manufacture of the barrel 12.

A pair of stops 44,46 are provided on the forwardly facing shoulder 40. Those stops 44, 46 will engage a flange 48 on the inside of the plug face 50 for a purpose to be described hereafter.

The plug 26 is cylindrical and adapted to fit within the tubular opening 24 of the barrel 12. A pin 52 is fixed to one end of the plug 26 and is received in a slot 54 in the dead bolt 18 so that rotation of the plug 26 will slide the dead bolt up and down in the direction of the arrow 22. Of course, as previously noted, the lock 10 of the present invention could be used in other applications, for example, to lock electrical switches.

A tab 56 is fixed on the outer surface of the plug 26 and secures the plug 26 within the barrel 12 as will be further described hereafter.

Five tumbler ways 58 are provided in the plug 26. The tumbler ways 58 extend substantially along parallel radii skewed at a 7° angle (see FIG. 3) from the radius on which the tab 56 lies. As will be apparent, the precise angle is not important so long as the tab 56 and tumbler ways 58 are skewed.

Figure 6:
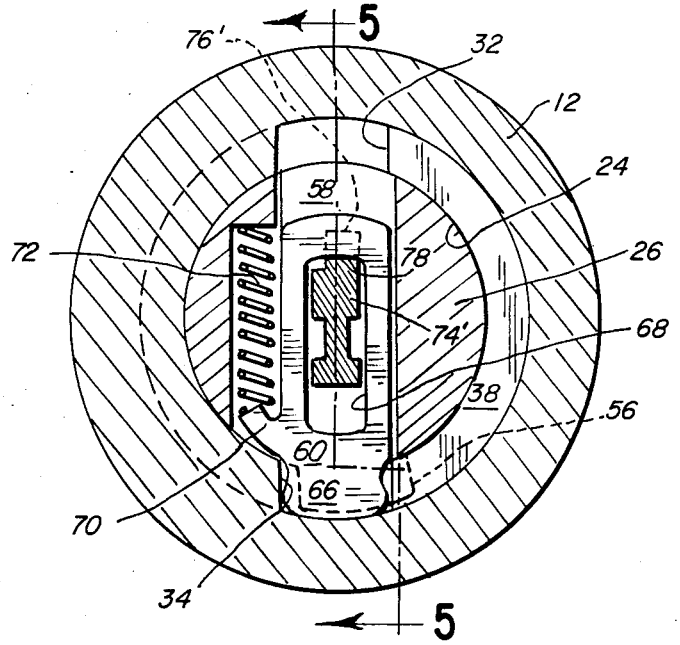
FIG. 6 is a cross-sectional view taken along line 6—6 of FIG. 5.

Tumblers 60–64 are located within each of the tumbler ways 58. Each tumbler 60–64 includes a head 66, a key slot 68 and an arm 70 as can be seen in FIGS. 3, 4 and 6. The arm 70 abuts a compression spring 72 within the plug 26 so that the tumblers 60–64 are biased toward projecting their heads 66 out from the tumbler ways 58.

The tumbler key slots 68 are arranged so that a key 74 extends therethrough when the key 74 is pushed into the plug 26 to operate the lock 10. The serrations 76 of the key 74 are adapted to abut the key slot surface 78 opposite the head 66 to hold each tumbler 60–64 completely within the tumbler ways 58 such as shown in FIG. 2.

The operation of the lock 10 is as follows. In order to locate the plug 26 within the barrel 12, a plug changing key 74 (see FIGS. 1–3) is inserted into the plug 26. The serrations 76 of the plug changing key 74 are formed to retract all five tumblers 60–64 into the tumbler ways 58 such as shown in FIG. 2. The plug 26 can therefore be slid into the tubular opening 24 of the barrel 12 by aligning the tab 56 within the fully axially extending slot 34 such as shown in FIG. 3.

Once the plug 26 is fully inserted into the barrel 12, the plug 26 may be rotated 7° counterclockwise from the removal position (shown in FIG. 3) to the bolt open position (shown in FIG. 6) with the axially extending slots 32,34 in alignment with the tumblers 60–64. The key 74 can then be removed from the plug 26 and the lock 10 is thus held in the bolt open position by the extension of the tumbler heads 66 into the axially extending slot 34. In the bolt open position, the tab 56 is no longer aligned with the axially extending slot 34 but rather is in the enlarged rear end 28 of the tubular opening 24. The tab 56 therefore abuts the rearwardly facing shoulder 30 to prevent the plug 26 from being pulled out of the barrel 12.

Normal operation of the lock 10 may then be accomplished by using the operating key 74' shown in FIG. 5. The operating key 74' is substantially the same as the plug changing key 74, except that the last serration 80 is different and does not retract the forwardmost tumbler 60 into the tumbler way 58.

The operating key 74' may thus be used to turn the lock 10 between the bolt open position (shown in FIGS. 5 and 6) and the bolt locking position (shown in FIG. 4). Specifically, since the forwardmost tumbler 60 is aligned with the annular slot 42 (see FIG. 5), it will not interfere with the turning of the lock 10 between the bolt open and locking positions. The other four tumblers 61–64 lock the plug 26 against rotation from either of these positions, and since the operating key 74' retracts those four tumblers 61–64, it may be used to operate the bolt 18. However, since the forwardmost tumbler 60 is not retracted by the operating key 74', it prevents the plug 26 from being rotated clockwise from the bolt open position to the removing position (and therefore, the operating key 74' cannot be used to remove the plug 26).

The forwardmost tumbler 60 also will prevent the plug 26 from being rotated counterclockwise past the bolt locking position. One stop 44 on the barrel 12 engages the plug flange 48 to also prevent counterclockwise rotation past the bolt locking position (in case the lock 10 is operated with a plug changing key 74).

Note that the serrations 76 are such that, as the key 74' is withdrawn, the serrations 82 on the end of the key would force tumblers 62,63 out of the top (as shown in FIG. 5) of their tumbler ways 58. This cannot of course be done unless the tumblers 62,63 are aligned with one of the axially extending slots 32,34 (i.e. the plug 26 is in either the bolt open or locking positions). Accordingly, the key 74 cannot be removed from the plug 26 unless the plug 26 is in either the bolt open or locking positions.

In order to remove the plug 26, the plug changing key 74 is inserted into the plug 26 as shown in FIG. 2 and the plug 26 is rotated clockwise past the bolt open position to the removal position. The plug flange 48 abuts barrel stop 46 in the removal position, in which the plug tab 56 is aligned with the fully axially extending slot 34. The plug 26 can therefore be pulled straight out of the barrel 12.

The annular slot 42 provided to permit the above operation may be located at any axial position along the barrel 12 as previously noted, and multiple slots may be provided in conjunction with a number of tumblers to provide still greater security for the lock 10 where desired. This structure would greatly complicate the task of someone attempting to make a plug removal key, even if that person had an operating key from which to work.

The present invention may thus be used in virtually any structure requiring a key lock. The lock 10 has two operative positions as is required in many structures. The key plug 26 may however be easily removed from the barrel 12 so that the tumblers 60–64 can be easily changed to change the key required to operate the lock 10. Therefore, should unauthorized persons obtain keys to the lock 10, the security provided by the lock 10 can be easily re-established without any costly or difficult disassembly.

Other aspects, objects and advantages of the present invention can be obtained from a study of the drawings, the disclosure and the appended claims.

What is claimed is:

1. A lock comprising:

a lock barrel with an opening therein;

a key plug rotatable within the barrel opening between first and second operative positions and a third position in which the plug can be withdrawn from the barrel;

a first tumbler adapted to lock the plug against turning within the barrel;

a second tumbler adapted to prevent the plug from turning to the third position and allowing rotation between the first and second positions;

an annular slot in the barrel adapted to receive the second tumbler as the plug is turned between the first and second positions;

a shoulder with an axial slot in the barrel; and a tab on the plug, said tab abutting the barrel shoulder to hold the plug therein during turning between the first and second positions, and said tab further being aligned with the axial slot when the plug is in the third position.

2. The lock of claim 1, wherein an operating key when extended into the plug retracts only the first tumbler to allow turning of the plug between the first and second positions, and a plug changing key when extended into the plug retracts both the first and the second tumbler to allow turning of the plug to the third position.

3. The lock of claim 1, wherein the first tumbler is received in the axial slot to lock the plug in one of the operative positions, and the tumblers lie on a different radius than the tab.

4. The lock of claim 3, wherein the first tumbler is received in the axial slot in the first position.

5. The lock of claim 4, further comprising third and fourth tumblers in the plug and received in the axial slot in the first position.

6. A lock comprising:

a lock barrel with a tubular opening having first and second axial slots spaced apart 180°;

a key plug within the opening and rotatable from a first to a second position during operation of the lock and from the first to a third position for withdrawal of the key plug from the barrel;

a first tumbler adapted to lock the plug against turning from the first position to the second position;

a second tumbler adapted to block the plug from turning from the first position to the third position, said second tumbler being fully retractable into the plug by a plug changing key to allow turning of the plug to the third position; and an annular slot about the tubular opening and adapted to receive the second tumbler therein when the plug is turned between the first and second positions;

wherein said tumblers are biased into the first axial slot when the plug is in the first position and biased into the second axial slot when the plug is in the second position.

7. A lock comprising:

a lock barrel with an opening therein;

a key plug within the opening and rotatable from a first to a second position during operation of the lock and from the first to a third position for withdrawal of the key plug from the barrel;

a first tumbler adapted to lock the plug against turning from the first position to the second position; and a second tumbler adapted to block the plug from turning from the first position to the third position, said second tumbler being fully retractable into the plug by a plug changing key to allow turning of the plug to the third position;

wherein a lock operating key has serrations which retract the first tumbler when the key is in the plug to permit turning of the plug between the first and second positions, and said lock operating key does not retract the second tumbler.

8. The lock of claim 7, wherein the plug changing key has serrations which retract the second tumbler when extended therein to permit turning of the plug from the first to the third position.

9. A lock operable by a first key and having a key plug removable therefrom by a second key, comprising:

a barrel defining a tubular opening;

a rearwardly facing shoulder about the tubular opening;

two axially extending slots in the tubular opening, one of said slots extending to the rearwardly facing shoulder to define an opening therein;

an annular slot about part of the tubular opening and extending between the axial slots;

a key plug having a plurality of tumblers ways therein and a tab extending therefrom at a position angularly spaced from the ways, said plug being receivable in the tubular opening and secured therein by engagement of the tab with the rearwardly facing shoulder;

a plurality of tumblers in the tumbler ways, one of the tumblers being axially aligned with the annular slot;

means biasing each of the tumblers out of the plug and into said one slot with the plug in a first position;

whereby the first key retracts all but said one tumbler into the plug so that said one tumbler moves in the annular slot as the plug is turned in one direction from the first position and engages the side of the axial slot to prevent turning of the plug in the opposite direction from the first position, and the second key retracts all tumblers to allow turning of the plug in the opposite direction from the first position to align the tab with the shoulder opening to permit axial withdrawal of the plug from the barrel.

10. The lock of claim 9, wherein the axially extending slots are on opposite sides of the tubular opening, whereby the plug may be turned in the first direction from the first position to a second position and the first key may be withdrawn therefrom to locate the tumblers in the other slot.

11. The lock of claim 9, further comprising a stop against rotation in the opposite direction when the tab is aligned with the shoulder opening.

* * * * *